US005664782A

United States Patent [19]

Lacks et al.

[11] Patent Number: 5,664,782

[45] Date of Patent: Sep. 9, 1997

[54] FOOTBALL DARTBOARD GAME

[76] Inventors: Christopher John Lacks; Randy Sean Lacks, both of 1007 NE. 2nd Ave., Jacksonville, Ala. 35265

[21] Appl. No.: 638,715

[22] Filed: Apr. 29, 1996

[51] Int. Cl.[6] ..... F41J 3/00

[52] U.S. Cl. ..... 273/317.5; 273/408; 273/409

[58] Field of Search ..... 273/317.5, 403, 273/404, 407, 408, 409

[56] References Cited

U.S. PATENT DOCUMENTS

| | | | |
|---|---|---|---|
| D. 137,907 | 5/1944 | Tremper | D34/5 |
| D. 229,207 | 11/1973 | Stitzer | D34/5 |
| D. 287,144 | 12/1986 | Dunn | D21/6 |
| D. 291,098 | 7/1987 | O'Connor | D21/6 |
| 3,979,117 | 9/1976 | Worsham | 273/408 |
| 4,415,162 | 11/1983 | Seppard | 273/408 X |
| 4,681,325 | 7/1987 | Sheem | 273/345 |
| 4,893,822 | 1/1990 | Tesa et al. | 273/376 |
| 4,948,148 | 8/1990 | Danielson | 273/408 |
| 5,005,842 | 4/1991 | Bauer | 273/408 |

OTHER PUBLICATIONS

"The Sporting Goods Dealer" Sep. 1970, p. 105.

"the safe dart game", Super Star Sports Games, 1976–7.

*Primary Examiner*—William H. Grieb

*Attorney, Agent, or Firm*—Wm. Randall May

[57] ABSTRACT

A dart game toy suitable for simulating the popular game of football includes a dartboard and a number of targets to be used by team players wherein such targets are sized and placed to correlate and simulate the skill required to achieve a desired and displayed result in accordance with the probability of achieving such a similar result in actual football play.

8 Claims, 6 Drawing Sheets

FOOTBALL DARTBOARD GAME

BACKGROUND AND SUMMARY OF THE INVENTION

This invention relates generally to games and more specifically, to dartboard type games.

The present invention resides in a plurality of dart boards having target areas designated for the selection of running, passing, and kicking plays for the game of American football. The game of football is simulated by projectile interaction, such as by throwing a dart, aiming a beam of light or by firing a gun, with one or more of the targets of the invention and by implementing, according to specified rules, the instruction or result indicated by the specific target identified by the resulting interaction. The objective of the sizing of the various targets of the present invention is to simulate a correlation of the skill required by the players in projecting an interaction with such targets to the desirability of the result indicated by the specific targets and to the probability of similar results in the actual game of football when played at a high school, college, or professional level.

Accordingly, a primary objective of the present invention is to devise dart throwing games which require not only dart throwing or aiming skills but also a high level of mental activity throughout the games, resulting in game psychology and strategy as complex as that to be found in the conventional games of football or baseball. This objective is obtained in the present invention first by providing four separate groups of targets: one group for running simulation, one group for passing simulation, one group for kickoff/punt simulation, and one group for fieldgoal/PAT ("point-after-touchdown") simulation; secondly by requiring that a play consists of a dart throw or other projectile interaction by one member of a "team" who repeatedly performs the directions specified by targets hit on each throw until a desired result is obtained, such as by scoring points, or until the "ball" is caused to be turned over to the other "team" member or player.

Another added feature of the present invention is that the ratios in sizes between simulated offensive and defensive type targets are designed to achieve a level of difficulty, or easiness, of both skill required to hit the desired target as well as the probability of a similar result in a real game of the simulated sport. Accordingly, players should consider not only the easiness or difficulty of his/her hitting a target area or piece with a dart or other projectile, but also the possibility and probability of hitting undesired targets such as would simulate fumble, interception, penalty, or blocked kicks such as blocked punts, blocked extra point attempts or fieldgoal attempts.

Another objective of the present invention is to simulate popular games such as football, baseball, and basketball, for both American and foreign models, using dart boards in order that people can enjoy, in their own chosen location, the excitement of game planning, game psychology and game strategy of each type game through the use of the embodiments of the present invention.

Another objective of the present invention is to provide opportunities for adults and children to learn, study and appreciate the various game rules, strategies, and play options through playing the simulated games embodied after the present invention.

The details of the features and advantages of the present invention will be further clarified in the following descriptions and associated drawings.

BRIEF DESCRIPTION OF THE DRAWINGS

The foregoing and other objects, features, and advantages of the present invention will be apparent from the following more particular description of preferred embodiments as illustrated in the accompanying drawings in which reference characters refer to the same parts throughout the various views. The drawings are not necessarily to scale, emphasis instead being placed upon illustrating the principles and utility of the invention.

INDEX OF REFERENCE CHARACTERS

100 Football Dartboard Game Apparatus
101 Base Rectangular Structure
102 Left Foldout Structural Element
103 Right Foldout Structural Element
104 Vertical Structural Elements
105 Hinges
200 Kickoff/Punt Target Panel
210 Kickoff/Return Target
211 Center Kickoff/Return Bullseye
212 Kickoff/Return Target Annular Rings
240 Punt/Return Target
241 Center Punt/Return Bullseye
242 Punt/Return Target Annular Rings
270 On Side Target
290 Kickoff
291 Punt
292 Return
293 Run Rectangle
300 Run Target Panel
310 Run Targets
320 Run Target Panel Vertical Segments
321 Run Target Panel Vertical Lines
322 Run Target Panel Horizontal Top and Bottom Boundaries
323 Panel Common Vertical Boundary
325 Square-Shaped Markers
400 Pass Target Panel
410 Pass Targets
420 Pass Target Panel Vertical Segments
421 Pass Target Panel Vertical Lines
422 Pass Target Panel Horizontal Top and Bottom Boundaries
425 Square-Shaped Markers
500 Fieldgoal/PAT Target Panel
510 Fieldgoal Target
511 Center Fieldgoal Bullseye
512 Fieldgoal Target Annular Rings
540 PAT Target
541 PAT Block Target
560 Two Point Conversion Targets
570 Fieldgoal

580 PAT
590 Pass Rectangle
600 Dart
700 Standard Scoreboard
710 Home Score Box
720 Visitors Score Box
731 Standard Scoreboard First Box
732 Standard Scoreboard Second Box
733 Standard Scoreboard Third Box
734 Standard Scoreboard Fourth Box
735 Standard Scoreboard Fifth Box
736 Standard Scoreboard Sixth Box
740 Standard Scoreboard Field
741 Standard Scoreboard Rectangular Area
750 Ten Yard Marker
800 Electronic Scoreboard
801 Time Remaining In Quarter
805 Home Score
810 Visitors Score
815 Timeouts (Home)
816 Timeouts (Home) Information Light
820 Down
825 Yards To Go
830 Ball On
835 Quarter
840 Timeouts (Visitors)
841 Timeouts (Visitors) Information Light
845 Time Information Light
850 Field Goals Information Light
855 Kickoff Information Light
860 Kickoff Return Information Light
865 Start Information Light
870 Punt Information Light
875 Punt Return Information Light
880 PAT Information Light
885 Penalties Information Light
890 Accept Information Light
895 Decline Information Light
899 Message Information Space
900 Horizontal Surface

DETAILED DESCRIPTION OF THE DRAWINGS

The objective of the Football Dartboard Game in accordance with the present invention is similar to American football.

Figure 1:
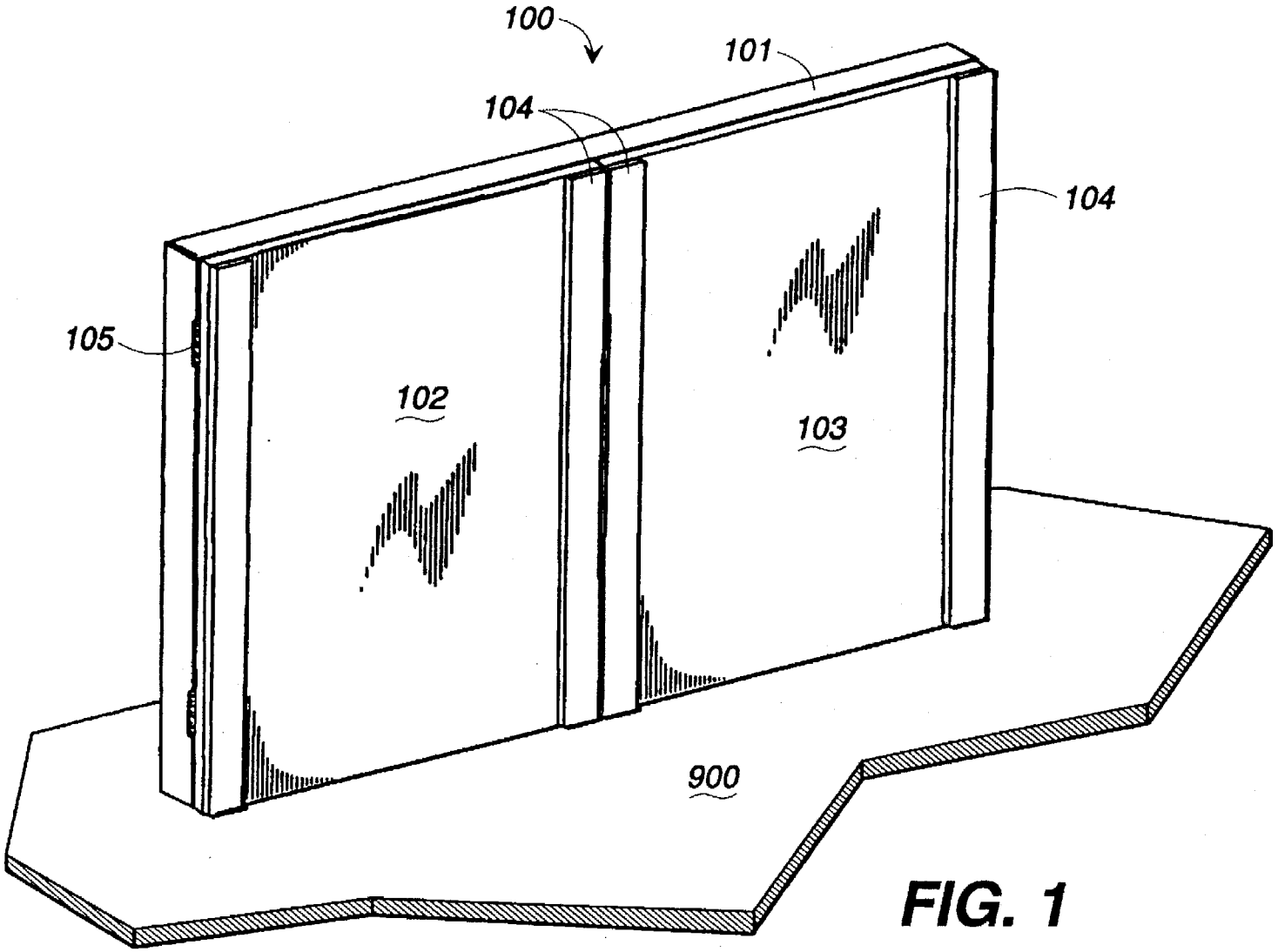
FIG. 1 is a perspective view of an embodiment of the dart board apparatus of the present invention shown in a folded or stored configuration.
Figure 2:
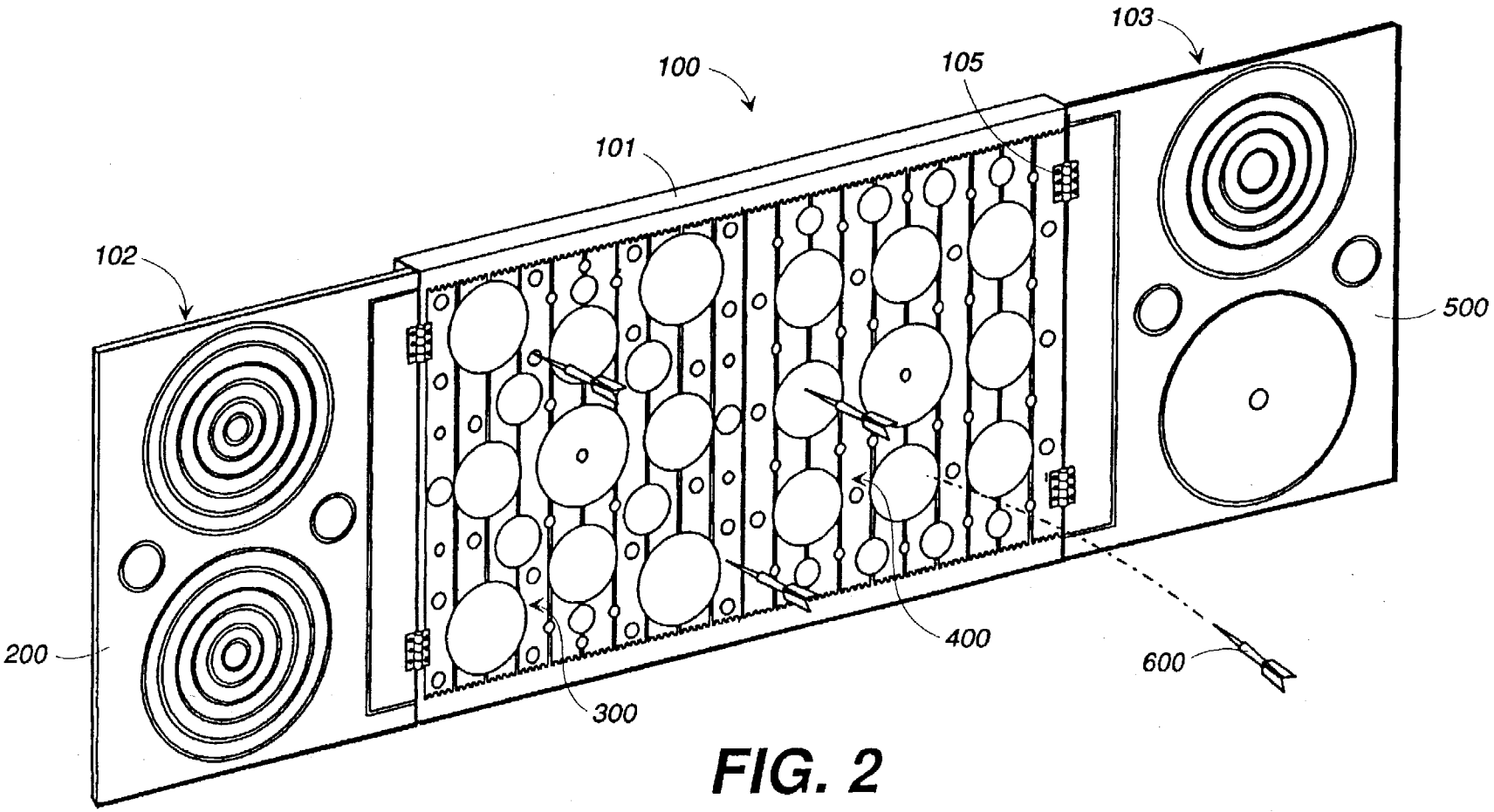
FIG. 2 is a perspective view of the embodiment of FIG. 1 shown in expanded form thereby displaying the configuration of the various targets as they would appear during game play.

The Football Dartboard Game apparatus 100 is shown in FIG. 1 in its folded or stored configuration. In the preferred arrangement, the various targets of the game are supported by a rectangular base structure 101 approximately 30 inches by 60 inches by 1 inch. As best seen in FIG. 2, two target groups are directly supported on the base structure 101 with another two target groups being supported by foldout structural elements 102 and 103 which are foldably attached to the base structure 101 by means of hinges 105. The foldout structural elements are light weight and their structural integrity is enhanced by vertical structural elements 104. Starting from the folded arrangement shown in FIG. 1, as the foldout structure elements 102 and 103 are rotated 180 degrees away from the base structure 101, the length of the extended Football Dartboard Game apparatus 100 is expanded to approximately 10 feet and the resulting arrangement is shown in FIG. 2 which displays the full board arrangement utilized when playing the game. As viewed in FIG. 2, a "Kickoff/Punt" Target Panel 200 is mounted on the left foldout structural element 102 and a "Fieldgoal/PAT" Target Panel 500 is mounted on the right foldout structural element 103. A "Run" Target Panel 300 is mounted on the left side of the base structure 101 adjacent to the Kickoff/Punt Target Panel 200, and a "Pass" Target Panel 400 is mounted on the right side of the base structure 101 adjacent to the Fieldgoal/PAT target panel 500.

In one arrangement, the Football Dartboard game apparatus 100 is supported from below by a horizontal surface 900, as shown in the folded arrangement of FIG. 1, with the dimensions of said horizontal surface 900 being sufficient to allow the rotation of the foldout structural elements 102 & 103 in order to support the expanded configuration as shown in FIG. 2. In another preferred arrangement, the Football Dartboard Game apparatus 100 may be supported by a vertical wall (not shown) whereby the non playing side of the base structure 101 is attached to said wall by suitable attaching means, such as wall hooks, thereby achieving a horizontal orientation of the Football Dartboard Game apparatus 100.

Figure 3:
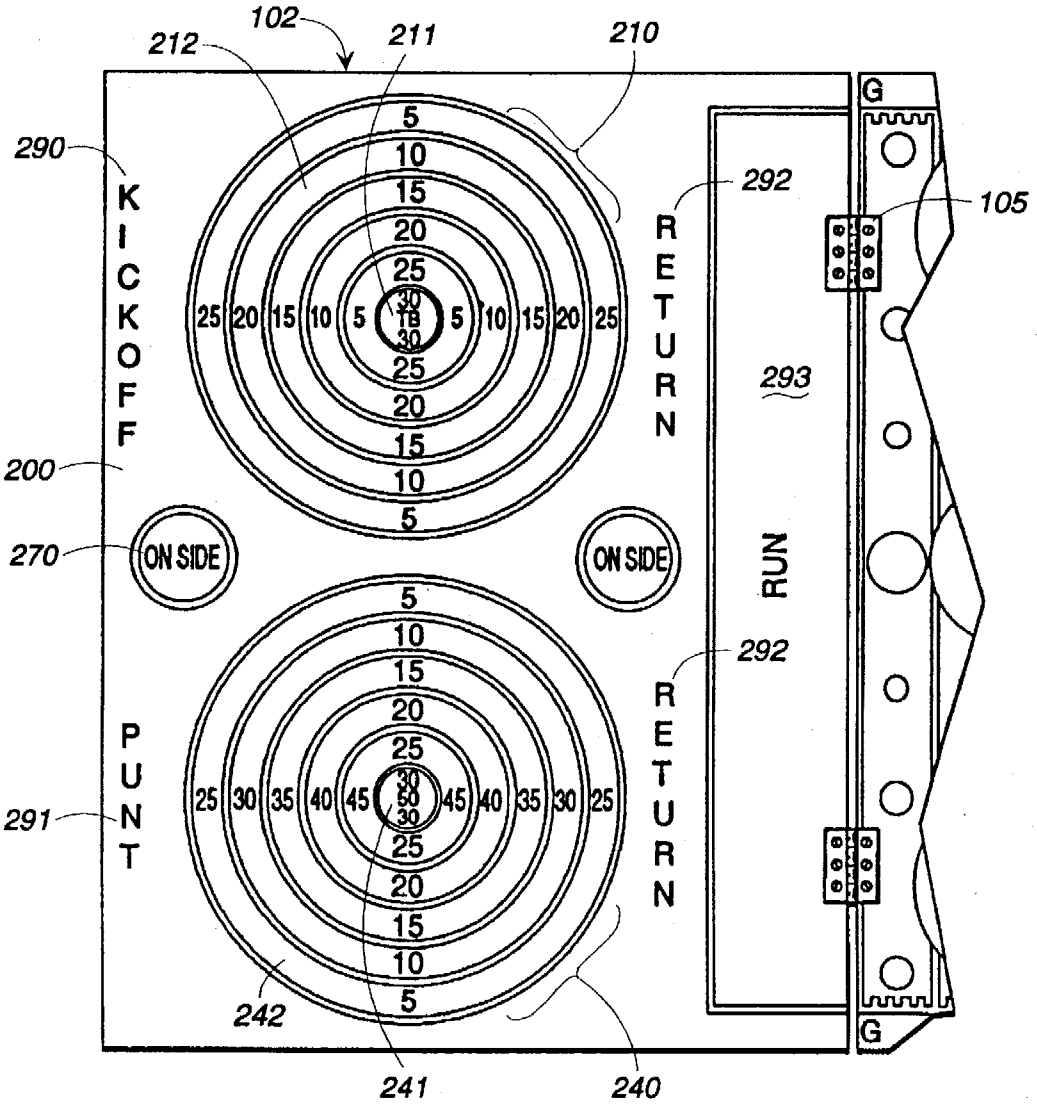
FIG. 3 is a front elevation view of the kickoff/punt panel of the embodiment of FIG. 2.

The preferred targets included on the Kickoff/Punt Target Panel 200 are shown in FIG. 3. A Kickoff/Return Target 210, located in the top portion of the Kickoff/Punt Target Panel 200, is arranged with a center kickoff/return bullseye 211 displaying the numerals and characters "30", "TB"(for "touchback"), and "30", arranged vertically, respectively, and has five kickoff/return target annular rings 212. Each annular ring 212 has an equal radial increment of approximately 1 and ½ inches and displays two sets of yardage numerals arranged in the following order: 25 and 5 on the outermost annulus, 20 and 10 on the next innermost annulus, 15 and 15 on the next innermost annulus, 10 and 20 on the next innermost annulus, and 5 and 25 on the innermost annulus. For kickoff yardage simulation, the yardage numerals displayed horizontally within the annular rings 212 of the Kickoff/Return Target 210 are used. These yardage numerals are arranged horizontally on the annular rings 212 as follows: starting from the outermost annulus with 25, the next innermost annulus with 20, the next innermost annulus with 15, the next inner most annulus with 10 and the innermost annulus with 5. For kickoff return yardage simulation, the yardage numerals displayed vertically within the annular rings 212 of the Kickoff/Return Target 210 are used. These yardage numerals are arranged vertically on the annular rings 212 as follows: starting from the outermost annulus with 5, the next innermost annulus with 10, the next inner most annulus with 15, the next innermost annulus with 20 and the inner most annulus with 25. The words "KICKOFF" 290 and "RETURN" 292 are displayed vertically and adjacent to the left and the right, respectively, of the Kickoff/Return Target 210.

A Punt/Return Target 240, located in the bottom portion of the Kickoff/Punt Target Panel 200 is arranged with a center punt/return bullseye 241 depicting the numerals "30", "50", and "30" arranged vertically, respectively, and has five punt/return annular rings 242. Each annular ring 242 of the Punt/Return Target 240 has an equal radial increment of approximately 1 and ½ inches and displays two sets of yardage numerals arranged in the following order: 25 and 5 on the outermost annulus, 30 and 10 on the next innermost annulus, 35 and 15 on the next innermost annulus, 40 and 20 on the next innermost annulus, and 45 and 25 on the innermost annulus. For punt yardage simulation, the yardage numerals displayed horizontally within the annular rings 242 of the Punt/Return Target 240 are used and are arranged as follows: starting from the outermost annulus with 25, the next innermost annulus with 30, the next innermost annulus with 35, the next innermost annulus with 40 and the innermost annulus with 45. For punt return yardage simulation, the yardage numerals displayed vertically within the annular rings 242 of the Punt/Return Target 240 are used and are arranged as follows: starting from the outermost annulus with 5, the next innermost annulus with 10, the next innermost annulus with 15, the next innermost annulus with 20, and the innermost annulus with 25. The words "PUNT" 291 and "RETURN" 292 are displayed vertically and adjacent to the left and the right, respectively, of the Punt/Return Target 240. Also included on the Kickoff/Punt Target Panel 200 are two circular "On Side" target 270 areas, approximately 3 and ½ inches in diameter, each depicting the words "ON SIDE", with one target located on the left side and at approximately mid height of the Kickoff/Punt Target Panel 200 and the other located on the right side at approximately the same height. In addition, on the right side of the Kickoff/Punt Target Panel 200, a "Run" rectangle 293, approximately 35 inches by 5 inches, with the long dimension oriented vertically, is located approximately equal distances from the top and bottom of the Kickoff/Punt Target Panel 200 and further located adjacent to the Run Target Panel 300, and contains the word "RUN" oriented to be read from a lateral view.

Figure 5:
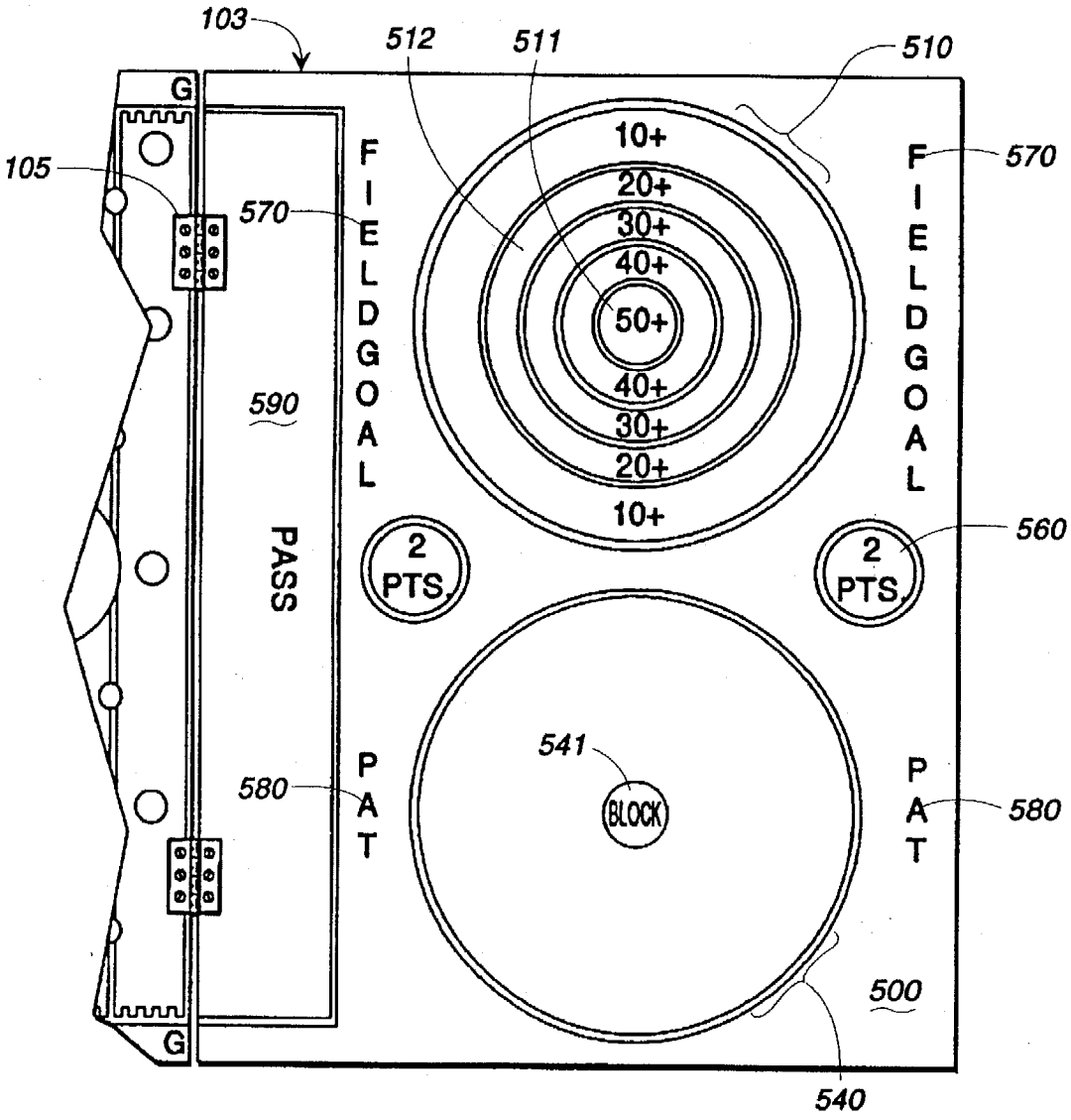
FIG. 5 is a front elevation of the fieldgoal/PAT targets panel of the embodiment of FIG. 2.

The preferred targets arranged on the Fieldgoal/PAT Target Panel 500 are shown in FIG. 5. A Fieldgoal Target 510, located in the top, central portion of the Fieldgoal/PAT Target Panel 500, is arranged with a center fieldgoal bullseye 511, approximately 3 inches in diameter, displaying the yardage numeral 50+, and has four fieldgoal target annular rings 512. Each of the inner three annular rings 512 of the Fieldgoal Target 510 has an equal radial increment of approximately 1 and ½ inches and the fourth or outer annulus having a radial increment of approximately 2 and ½ inches. Each fieldgoal target annular ring 512 contains a number designation arranged vertically such that the number 10+ is displayed in the outer most annulus, the number 20+ is displayed in the next inner most annulus, the number 30+ is displayed in the next inner most annulus, and the number 40+ is displayed in the inner most annulus. The letters of the word "FIELDGOAL" 570 are displayed vertically lateral to the Fieldgoal Target 510 on either side thereof and at approximately the same height. A circular PAT Target 540 of approximately 17 inch diameter is used to denote the simulation of a point-after-touchdown attempt and is located below the Fieldgoal Target 510 and contains a centrally located PAT Block Target 541 of approximately 1 and ½ inch diameter, displaying the word "BLOCK". Two circular, approximately 3 and ½ inch diameter, Two Point Conversion Targets 560 are located at mid height of the Fieldgoal/PAT Target Panel 500 on either side thereof. The Two Point Conversion Targets 560 each contain the designation "2" and "PTS.", vertically arranged, with "2" being situated above the designation "PTS.". The word "PAT" 580 is displayed vertically and adjacent to the PAT Target 540 on both the left and the right side of the PAT Target 540. In addition, on the left side of the Fieldgoal/PAT Target Panel 500, a PASS Rectangle 590, approximately 35 inches by 5 inches, with the long dimension oriented vertically, is located approximately equal distances from the top and the bottom of the Fieldgoal/PAT Targets Panel 500 and further located adjacent to the PASS Target Panel 400, and contains the word "PASS" oriented to be read from a lateral view.

Figure 6:
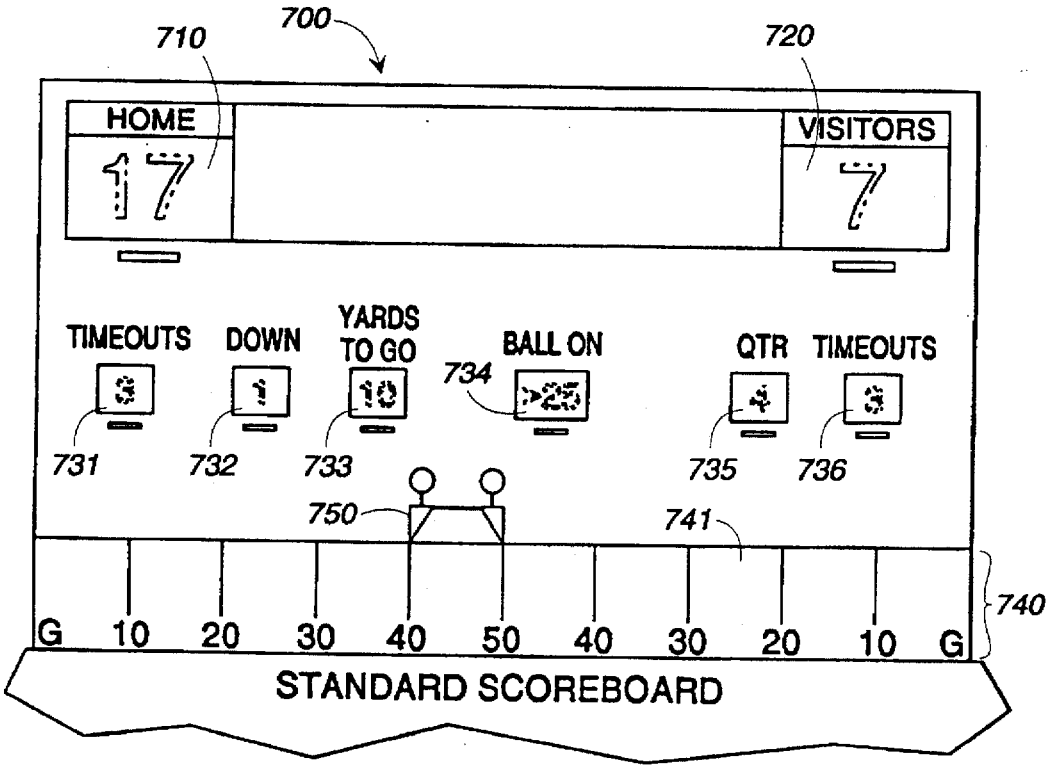
FIG. 6 is a front elevation of the standard score board for the game depicted by the embodiment of FIG. 2.

A preferred standard scoreboard 700 is shown in FIG. 6 and is made of an approximately 2 feet by 3 feet rectangular solid of ⅜ inch thickness, such as cork board or plywood. The standard scoreboard 700 has a viewing surface which displays a plurality of numbers, words, and symbols. An approximately 3 inch by 4 inch Home score box 710 is located in the top left corner of the standard scoreboard 700 and displays the word "HOME" in the top most portion thereof and has a surface which is disposed such that scoring numbers may be repeatedly written and erased. An approximately 3 inch by 4 inch Visitors score box 720 is located in the top right corner of the standard scoreboard 700 and displays the word "VISITOR" in the top most portion thereof and has a surface which is disposed such that scoring numbers may be repeatedly written and erased. Six boxes are horizontally arranged across the mid height of the standard scoreboard 700 each allowing game numbers to be repeatedly written and erased. These six boxes are, from left to right on the standard scoreboard 700: a standard scoreboard first box 731 which is 2 inches by 2 inches and has the word "TIMEOUTS" displayed immediately above, a standard scoreboard second box 732 which is 2 inches by 2 inches and has the word "DOWN" displayed immediately above, a standard scoreboard third box 733 which is 2 inches by 2 inches and has the words "TO GO" displayed immediately above with the additional word "YARDS" displayed immediately above the words "TO GO", a standard scoreboard fourth box 734 which is 2 inches by 3 inches and has the words "BALL ON" displayed immediately above, a standard scoreboard fifth box 735 which is 2 inches by 2 inches and contains the abbreviated word "QTR" immediately above, and a standard scoreboard sixth box 736 which is 2 inches by 2 inches and displays the word "TIMEOUTS" immediately above. The length of the football field is simulated across the bottom of the standard scoreboard 700. The standard scoreboard 700 also contains ten equal rectangular areas 741 which are marked approximately 3.6 inches by 3.6 inches to depict the standard scoreboard field 740. The letter G is displayed on the standard scoreboard 700 at the bottom and adjacent to each of the farthest distance vertical sides of the 3.6 inches by 3.6 inches standard scoreboard rectangular areas 741. Starting from the common side of the middle two standard scoreboard rectangular areas 741, which is marked "50" at the bottom of the standard scoreboard 700, each next vertical, common side between two adjacent standard scoreboard rectangular areas 741 is marked as: 40 for the first common side, 30 for the next common side, 20 for the next common side, and 10 for the final common side. A ten yard marker 750 is movably attached to the rectangular areas 741 of the standard scoreboard 700, such as by use of Velcro, and is dimensioned to be the horizontal length of one of the standard scoreboard rectangular areas 741. Said marker 750 is shaped to simulate poles or posts connected by a linear element on each horizontal end.

Figure 4:
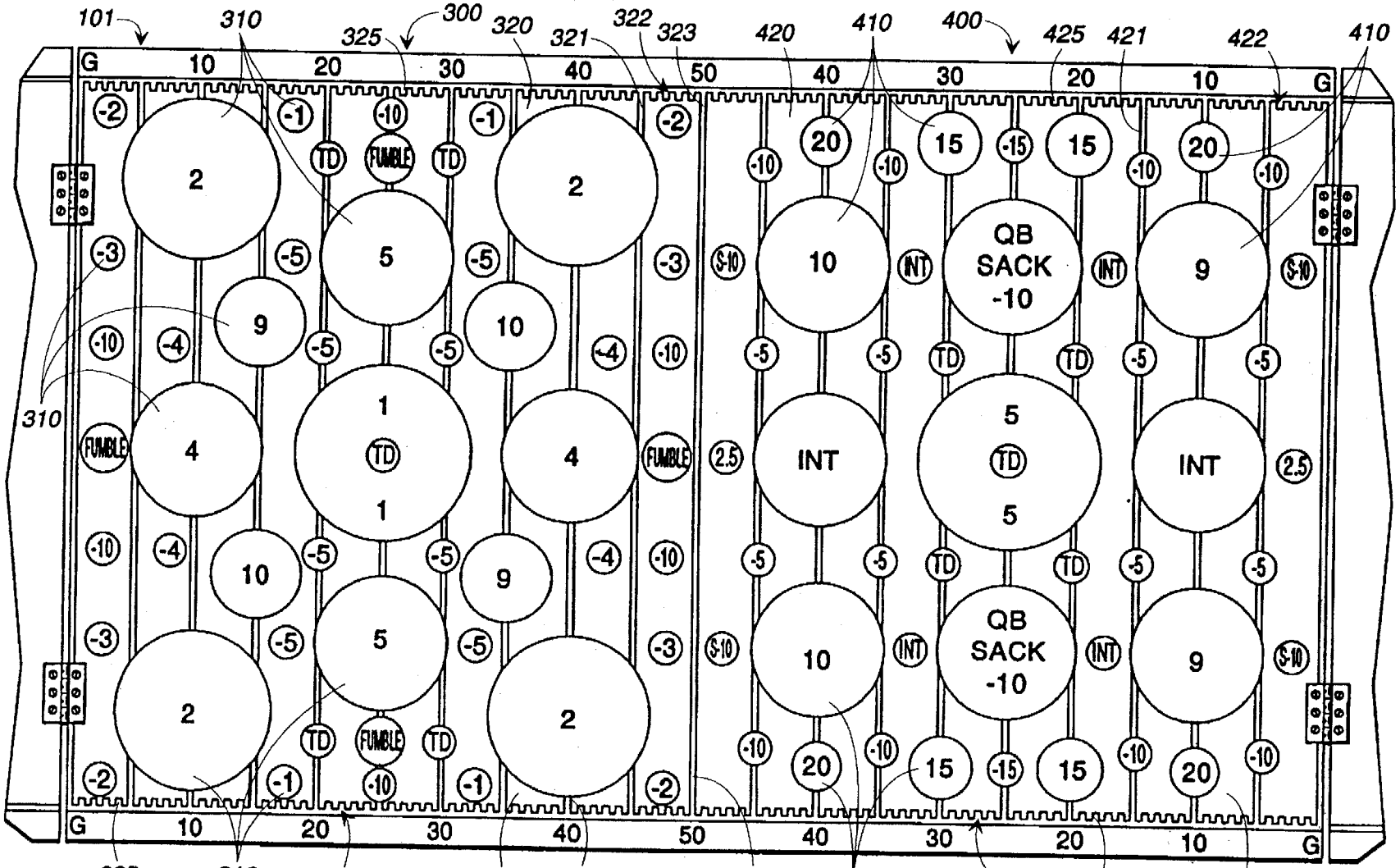
FIG. 4 is a front elevation of the run targets panel of the embodiment of FIG. 2.

The preferred targets included on the "Run" Target Panel 300 of the base rectangular structure 101 are shown in the left half of FIG. 4. The Run Target Panel 300 includes a plurality of circular Run Targets 310 each containing a displayed number representing a desired positive yardage for the offensive team to advance the ball. The Run Targets 310 are designated such that the larger the target, the smaller the advance of the ball, with targets sized to correlate to the simulation probability of offensive desirable ball movement of 1 to 10 simulated yards. The Run Targets 310 also include a plurality of smaller targets displaying a value to the offense of scoring a TD, meaning a "touchdown", and further including a plurality of circular targets indicating negative simulated yardage for the offensive team to experience, and with several targets displaying the word "FUMBLE" to indicate a direction to change control of the ball to the defensive team. The Run Target Panel 300 is further divided into 10 equal vertical segments 320 bounded by vertical lines 321 over approximately 95% of the height of the Run Target Panel 300 allowing space at the top and the bottom to display, from left to right, the following: G aligned with the first vertical line, 10 aligned with the third vertical line, 20 aligned with the fifth vertical line, 30 aligned with the seventh vertical line, and 40 aligned with the ninth vertical line. Further, the Run Target Panel 300 is bounded by horizontal top and bottom boundaries 322 which are formed by four equa-distant square shape markers 325 of equal size beginning a distance from the left most Run Target Panel vertical line 321 equal to the length of one side of the square. A panel common vertical boundary 323 divides the Run Target Panel 300 and the Pass Target Panel 400. The number "50" is displayed above and below, and aligned with, the panel common vertical boundary 323.

The preferred targets included on the Pass Target Panel 400 are shown, on the right half of the base structure 101, in FIG. 4. The Pass Target Panel 400 includes a plurality of circular Pass Targets 410 each containing a displayed number representing a desired positive yardage to advance the ball. The Pass Targets 410 are designated such that the larger the target, the smaller the advance of the ball, with targets sized to correlate to the simulation probability of offensive desirable ball movement of 5 to 20 simulated yards. The Pass Targets 410 also include a plurality of smaller targets displaying a value to the offense of scoring a TD, meaning a "touchdown", and further including a plurality of circular targets indicating negative simulated yardage for the offensive team to experience, and with several targets displaying "INT" to simulate an interception of a pass indicating a direction to change control of the ball to the defensive team. The Pass Target Panel 400 is further divided into 10 equal pass target panel vertical segments 420 bounded by pass target panel vertical lines 421 over approximately 95% of the height of the Pass Target Panel 400 allowing space at the top and bottom to display, from left to right, the following: 40 aligned with the third vertical boundary counting the panel common vertical boundary 323 as the first pass target panel vertical line, 30 aligned with the fifth vertical line, 20 aligned with the seventh vertical line, 10 aligned with the ninth vertical line, and G aligned with the eleventh vertical line. Further, the Pass Target Panel 400 is bounded by horizontal top and bottom boundaries 422 which are formed by four equa-distant square shape markers 425 of equal size being a distance from the left most pass target panel vertical line 421 equal to the length of one side of the square.

On both the Run Target Panel 300 and the Pass Target Panel 400 a plurality of circular, yellow penalty targets (not shown in color and not numbered in FIG. 4) are dispersed. Each such target contains a negative number from the set: −5, −10, −15, representing a penalty for the team hitting such a target in their dart throw.

The game begins with a member of the Selected defensive team throwing a dart at, or facilitating the interaction of other projection means with, the Kickoff/Return Target 210 and by placing the ball, by simulation, on the standard scoreboard 700 at a location equal to the numeric result of the kick off dart throw by the defensive team. Next, a player on the offensive team throws a dart 600 at the Kickoff/Return Target 210 and the ball is advanced by the numeric result of the return dart throw by the offensive team or in the event no target is hit the ball is not further advanced. If the defensive team's kickoff dart throw hits the center kickoff bullseye 211, then the offensive team does not have a kickoff return dart throw, and their drive begins on their 20 yard line. If the defensive team chooses, prior to their kickoff dart throw, it may announce an "ONSIDE" kickoff attempt and if one of the ONSIDE targets 270 are hit, the kickoff team becomes the offensive team and their drive begins on the 50 yard line. Next, a member of the offensive team throws a dart at either a Run Target 310 or a Pass Target 410. Next, the ball is moved, by simulation, on the standard scoreboard 700 an amount equal to its present location plus the numeric result of the offensive player's dart throw. However, if the offensive team dart throw results in the hitting of a target displaying the word "FUMBLE" or "INT", control of the ball switches to the defensive team. Further, if the result of the offensive team dart throw is an interaction with a "TD" designation, then the ball is moved to the scoring goal line of the offense team and their score is increased by 6 points. After achieving a TD, the offensive team chooses to throw at the PAT Target 540 or the Two Point Conversion Target 560. If one of these targets is hit, the offense team score is increased by 1 or 2 points, respectively. However, if the offensive team chooses to throw at the PAT Target 540 and the dart throw results in hitting the PAT block target 541 the point-after-touchdown kick attempt is blocked and no extra point score is registered. Next, the offensive team kicks off as described above.

During a drive, if the ball moves by 10 yards or more, the offensive team is given a new set of four downs, however if the ball has not advanced 10 yards after four downs (dart throws), the ball control switches to the defense. Further, during a drive, the offensive team may choose to punt by throwing at the Punt/Return Target 240 followed by the defensive team throwing at the Punt/Return Target 240 and the ball is moved from its current location to the sum of the movements directed by each of the prior two throws. Also, during a drive the offensive team may choose, depending on the ball location yard line which has been reached, to attempt an interaction with the Fieldgoal Target 510. And, if the resulting numeric yardage is in excess of the yardage between the current ball location and the offensive team's scoring goal line plus 10 yards, then the offense team score is increased 3 points, however if this distance is not exceeded the control of the ball switches to the defensive team at its current yardage location on the simulated field as indicated on the scoreboard 700 or 800.

During play, if a penalty target is hit, the down is repeated, however the ball is moved the amount of yards displayed on the target away from the scoring goal line of the team hitting the penalty target. Alternately, a penalty may be declined by the opposing team in which case the down is not repeated and no negative yardage is assessed.

In the preferred embodiment, the rules of playing the game include dividing the 60 minute game into four equal 15 minute quarters and a 15 minute half time intermission. Also, each team is allowed three timeouts per half.

Figure 7:
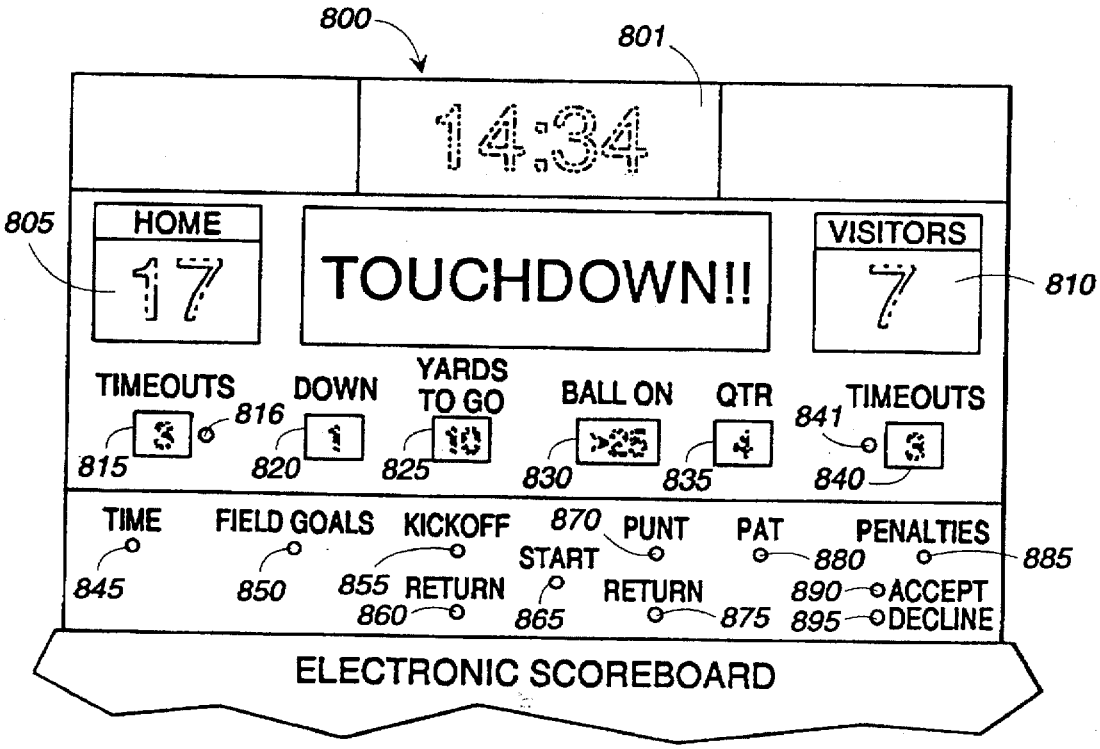
FIG. 7 is a front elevation of the electronic score board for the game depicted by the embodiment of FIG. 2.

An alternate preferred embodiment for the standard scoreboard 700 is an electronic scoreboard 800 an embodiment of which is shown in FIG. 7. The information displayed on the electronic scoreboard 800 consists of variable information, message information, information lights, and fixed identifying information. Information regarding the result of a dart throw is electronically detected and input to the electronic scoreboard 800. Additional information is input to the electronic scoreboard 800 through switches controlled by the offensive and defensive players. The following items of variable information are updated automatically and viewably displayed by means of electronic digital form: Time Remaining in Quarter 801, Home Score 805, Visitors Score 810, Timeouts (Home) 815, Down 820, Yards To Go 825, Ball On 830, Quarter 835, and Timeouts (Visitors) 840. Identifiably adjacent to each indicated item of variable information, the following words are viewably, continuously displayed: "HOME" by Home Score 805, "VISITORS" by Visitors Score 810, "TIMEOUTS" by Timeouts (Home) 815, "DOWN" by Down 820, "YARDS TO GO" by Yards To Go 825, "BALL ON" by Ball On 830, "QTR" by Quarter 835, and "TIMEOUTS" by Timeouts (Visitors) 840. The following words are viewably, continuously displayed identifiably adjacent to an identified information light: "TIME" by time information light 845, "FIELD GOALS" by field goals information light 850, "KICKOFF" by kickoff information light 855, "RETURN" by kickoff return information light 860, "START" by start information light 865, "PUNT" by punt information light 870, "RETURN" by punt return information light 875, "PAT" by PAT information light 880, "PENALTIES" by penalties information light 885, "ACCEPT" by accept information light 890, and "DECLINE" by decline information light 895. Further, Timeouts (Home) information light 816 is viewably located identifiably adjacent to Timeouts (Home) 815 and Timeouts (Visitors) information light 841 is viewably located identifiably adjacent to Timeouts (Visitors) 840. A message information space 899 is viewably centrally located on the electronic scoreboard 800 and displays pre-recorded short messages related to the game that are automatically displayed upon corresponding preselected events of game play.

It will be understood that the meaning of the term dart 600 encompasses additional means of projecting an interaction with a target in alternate preferred embodiments such as the projection of a light beam or the aiming and firing of a pellet or BB type air gun.

It is obvious that the teachings of the present invention may be embodied into various ways in varying forms. Accordingly, although only preferred embodiments are specifically illustrated and described herein, it well be apparent that many modifications and variations of the present invention are possible in light of the above teachings and within the purview of the appended claims without departing from the spirit and intended scope of the invention.

The embodiments of the invention in which an exclusive property right or privilege is claimed is defined as follows:

1. An apparatus for playing a dart game simulating the game of football comprising:

a. a game board apparatus comprising a simulated football field having a run play target panel and a pass play target panel, and further comprising a kickoff/punt target panel and a fieldgoal/point-after-touchdown (PAT) target panel, b. said game board and target panels possessing a means for receiving the interaction of projectile means, c. at least one projectile means, d. said run play target panel comprising a portion of said simulated football field and having a plurality of circular run-play targets including positive and negative targets as well as targets indicating "fumble" and "touchdown", e. said pass play target panel comprising a portion of said simulated football field and having a plurality of circular pass-play targets including positive and negative yardage targets as well as targets indicating "interception", "quarterback sack" and "touchdown", f. said kickoff/punt target panel comprising a pair of large circular targets and further comprising a pair of smaller circular targets indicating "on-side kick", g. said fieldgoal/point-after-touchdown (PAT) target panel comprising a pair of large circular targets and further comprising a pair of smaller circular targets indicating "2 point conversion", h. so that players or groups of players may accurately simulate the gameplay of the game of football under a set of gameboard rules whereby a football is advanced and scores obtained through an interactive sequence of alternate team participation in the projection of said projectile means onto said game board apparatus.

2. The apparatus according to claim 1, wherein said game board is of singular construction and further comprises foldable panels for ease of storage and transportation of the apparatus.

3. The apparatus according to claim 1, wherein said kickoff/punt panel and said fieldgoal/point-after-touchdown panel are situated adjacent to said simulated football field.

4. The apparatus according to claim 1, wherein said circular targets of said run play target panel and said pass play target panel vary in diameter.

5. The apparatus according to claim 1, wherein said large circular targets of said kickoff/punt target panel further comprise a plurality of concentric rings.

6. The apparatus according to claim 1, wherein said large circular targets of said fieldgoal/point-after-touchdown target panel further comprise one or more concentric rings.

7. The apparatus according to claim 1, wherein said game board apparatus further comprises a detached scoreboard comprising a simulated football field sideline for tracking ball position and placement of yardage markers and further comprises a plurality of surfaces designated for posting of game statistics during play.

8. The apparatus according to claim 7, wherein said game statistics are posted electronically.

* * * * *